US007598676B2

(12) United States Patent
Serita et al.

(10) Patent No.: US 7,598,676 B2
(45) Date of Patent: Oct. 6, 2009

(54) DISCHARGE LAMP

(75) Inventors: Takuya Serita, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 415 days.

(21) Appl. No.: 11/706,003

(22) Filed: Feb. 13, 2007

(65) Prior Publication Data

US 2007/0194678 A1 Aug. 23, 2007

(30) Foreign Application Priority Data

Feb. 17, 2006 (JP) ..... 2006-040970

(51) Int. Cl.
*H01J 17/18* (2006.01)

(52) U.S. Cl. ..... 313/623; 313/624

(58) Field of Classification Search ..... 313/634, 313/635, 636; 315/56, 76
See application file for complete search history.

(56) References Cited

U.S. PATENT DOCUMENTS 6,274,973 B1 * 8/2001 Mochiduki et al. ..... 313/318.09
6,819,047 B2 * 11/2004 Niimi ..... 313/623
6,825,616 B2 * 11/2004 Kobayakawa et al. ..... 313/636

FOREIGN PATENT DOCUMENTS

JP 2005-228520 8/2005

* cited by examiner

*Primary Examiner*—Douglas W Owens
*Assistant Examiner*—Minh D A
(74) *Attorney, Agent, or Firm*—Osha • Liang LLP

(57) ABSTRACT

A discharge lamp includes a coaxial waveguide for high-frequency electromagnetic wave transmission and a discharge tube for emitting light of discharge by plasma generated by electromagnetic waves. The coaxial waveguide includes an internal conductor and a pipe-shaped external conductor surrounding the internal conductor. The discharge tube is attached to a top of the coaxial waveguide, and is constructed in a double end shape in which both ends of a glass tube are pinched and sealed. The glass tube includes an ellipse spherical bulged part formed in a middle of a longitudinal direction. An inside of the ellipse spherical bulged part forms discharge space. A conductor assembly is sealed and attached to at least a proximal side pinch seal part. The proximal side pinch seal part of the discharge tube is inserted and held in a top opening of the coaxial waveguide.

20 Claims, 13 Drawing Sheets

W
23
A

P
W
A 26c
26c1
26b
26a
A'
W
A

26c1
A'
A
W

A'
A
W

A'
A
W

FIG. 7 (a)
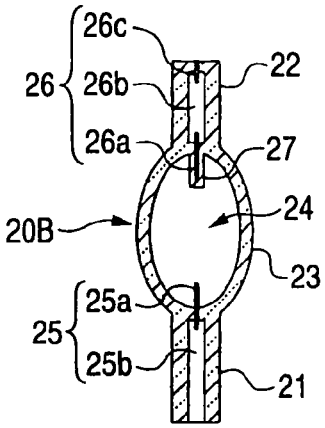
FIG. 7 (b)
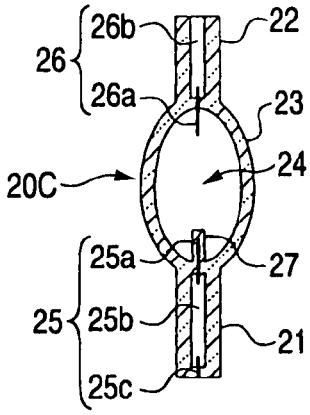
FIG. 7 (c)
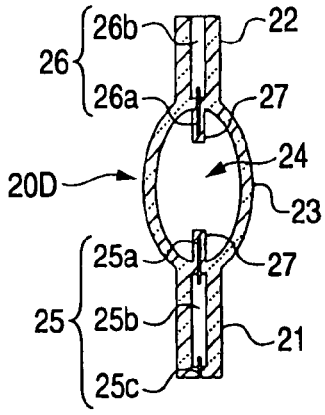
FIG. 7 (d)
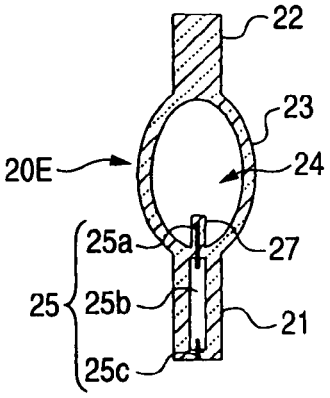
FIG. 7 (e)
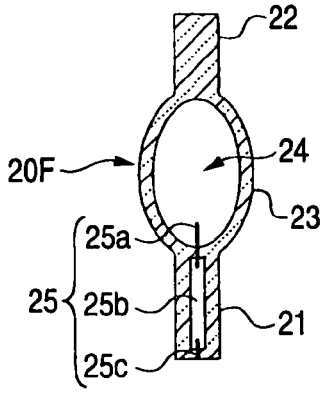
FIG. 7 ( f )
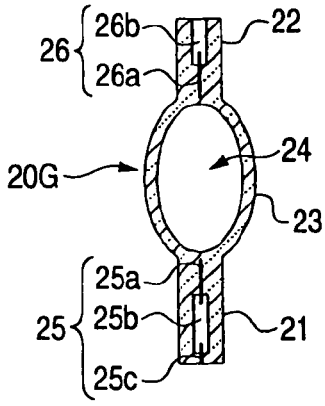
FIG. 8
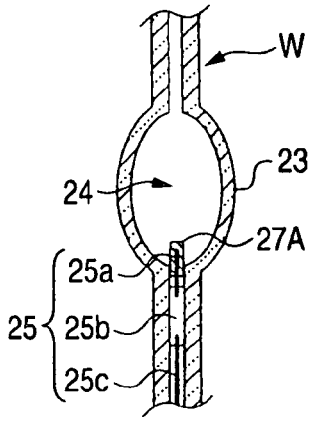

FIG. 9

| EXPERIMENT NO. | EMBODIMENT | AL (mm) | EL (mm) | ID (mm) | OD (mm) | ENCLOSURE Xe PRESSURE (atm) | LUMINOUS FLUX (lm) | EFFICIENCY (lm/W) |
|---|---|---|---|---|---|---|---|---|
| 1 | FIRST EMBODIMENT | 6mm | 4mm | 2.5mm | 6.2mm | 10atm | 4200lm | 140lm/W |
| 2 | FIRST EMBODIMENT | 6mm | 4mm | 2.5mm | 6.2mm | 5atm | 3100lm | 103lm/W |
| 3 | FIRST EMBODIMENT | 6mm | 4mm | 2.5mm | 6.2mm | 15atm | 4900lm | 163lm/W |
| 4 | FIRST EMBODIMENT | 6mm | 5mm | 2.5mm | 6.2mm | 10atm | 4900lm | 163lm/W |
| 5 | FIFTH EMBODIMENT | 6mm | 4mm | 3.5mm | 7.2mm | 10atm | 3800lm | 127lm/W |
| 6 | FIFTH EMBODIMENT | 6mm | 4mm | 2.5mm | 6.2mm | 10atm | 3900lm | 130lm/W |
| 7 | SIXTH EMBODIMENT | 6mm | 5mm | 2.5mm | 6.2mm | 10atm | 4500lm | 130lm/W |
| 8 | SEVENTH EMBODIMENT | 6mm | 5mm | 2.5mm | 6.2mm | 10atm | 4900lm | 163lm/W |

FIG. 11

| | 30w | 50w | 100w | 150w |
|---|---|---|---|---|
| COLUMN (ϕ4mm, 6mm) | 30w/cm$^2$: ×1 | 50w/cm$^2$: ×1 | 100w/cm$^2$: ×1 | 149w/cm$^2$: ○ |
| ELLIPSE SPHERE (MAJOR AXIS: 2.25mm, MINOR AXIS: 1.35mm) | 77w/cm$^2$: ○ | 131w/cm$^2$: ○ | 262w/cm$^2$: ×2 | 393w/cm$^2$: ×2 |
| ELLIPSE SPHERE (MAJOR AXIS: 3.0mm, MINOR AXIS: 2.0mm) | 40w/cm$^2$: ×1 | 66w/cm$^2$: ○ | 132w/cm$^2$: ○ | 198w/cm$^2$: ○ |

FIG. 12

| | 30w | 50w | 100w |
|---|---|---|---|
| ϕ0.10mm | ○ | ○ | ×1 |
| ϕ0.25mm | ×2 | ○ | ○ |
| ϕ0.30mm | ×2 | ○ | ○ |
| ϕ0.40mm | ×2 | ×2 | ○ |

DISCHARGE LAMP

CROSS-REFERENCE TO RELATED APPLICATIONS

If applicable.

BACKGROUND OF INVENTION

1. Field of the Invention

The present invention relates to a discharge lamp comprising a discharge tube for emitting light of discharge by plasma generated by electromagnetic waves transmitted by a coaxial waveguide for high-frequency electromagnetic wave transmission constructed of an internal conductor and an external conductor.

2. Background Art

FIGS. 13 and 14 are a conventional discharge lamp shown in the following Patent Reference 1, and comprise a coaxial waveguide 1 for high-frequency electromagnetic wave transmission constructed of an internal conductor 2 and an external conductor 3, and a discharge tube 4 which is attached to the top of the waveguide 1 and emits light of discharge by plasma generated by electromagnetic waves transmitted by the waveguide 1 and has an outside diameter almost equal to an outside diameter of the waveguide 1.

That is, the top of the waveguide 1 for transmitting high-frequency electromagnetic waves generated by a sending part is provided with an electromagnetic wave irradiation part 6 comprising an internal conductor 6*a* and an external conductor 6*b* respectively connected to the internal conductor 2 and the external conductor 3 of the waveguide 1, and by electromagnetic waves (a high-frequency electric field generated by the electromagnetic wave irradiation part 6) irradiated from an annular top plate part 6*b*1 of the external conductor 6*b* and a disk top part 6*a*1 of the internal conductor 6*a* opposed with an annular slit 6*c* sandwiched between the parts, high-density plasma is generated inside the discharge tube 4 and a light emission substance of the inside of the discharge tube 4 is evaporated and excited and emits light.

Since an electrode is not disposed inside discharge space of the discharge tube 4, there is no heat loss from the electrode and light emission efficiency (lumen/watt) of the discharge tube improves accordingly and it is unnecessary to consider a reaction between a conductor assembly and an enclosure substance (a metal halide) of the inside of the discharge space, so that a light emission substance suitable to improve the light emission efficiency can be used.

[Patent Reference 1] JP-A-2005-228520

However, in the conventional art described above, since electromagnetic waves are guided to the discharge space through a bottom wall of the discharge tube 4, Joule loss by heating of the bottom wall is large and the bottom wall of the discharge tube 4 is arranged so as to make contact with a top surface (the disk-shaped top part 6*a*1 of the internal conductor 6*a* and the annular top plate part 6*b*1 of the external conductor 6*b*) of the electromagnetic wave irradiation part 6 with a large heat capacity, so that loss by heat conduction is large and light emission efficiency does not increase and further it is difficult to manufacture the discharge tube and new manufacturing equipment is required.

Also, the discharge tube 4 is a bottomed cylindrical body with a large surface area and has large loss of heat radiation from the tube surface and has less efficiency of light emission and further is not realistic in the case of considering a process of manufacturing the discharge tube 4.

SUMMARY OF INVENTION

Therefore, an inventor considered the possibilities of applying a basic structure of a high-intensity discharge tube (arc tube) widely used as a light source of a vehicle lamp such as a head lamp for automobile and prototyped and tested, with the result that the inventor determined that desired efficiency of light emission can be obtained while manufacture can be performed simply.

Accordingly, embodiments of the invention provide a discharge lamp comprising a discharge tube for emitting light of discharge by plasma generated by high-frequency electromagnetic waves transmitted by a coaxial waveguide, the discharge tube having good efficiency of light emission and being easy to manufacture.

In one or more embodiments, in a discharge lamp comprising a coaxial waveguide for high-frequency electromagnetic wave transmission constructed of an internal conductor and a pipe-shaped external conductor surrounding the internal conductor, and a discharge tube which is attached to the top of the waveguide and emits light of discharge by plasma generated by electromagnetic waves, it is constructed so that the discharge tube is constructed in a double end shape in which both ends of a glass tube in which an ellipse spherical bulged part is formed in the middle of a longitudinal direction are pinched and sealed and thereby a conductor assembly is sealed and attached to at least a proximal side pinch seal part and the inside of the ellipse spherical bulged part forms discharge space and also an electromagnetic wave irradiation part is constructed by the conductor assembly and the external conductor top of the waveguide surrounding the conductor assembly by inserting and holding the proximal side pinch seal part of the discharge tube in a top opening of the waveguide so that the conductor assembly approaches the internal conductor of the waveguide.

The inside of discharge space is irradiated with electromagnetic waves transmitted by a coaxial waveguide from an electromagnetic wave irradiation part constructed by a first conductor assembly sealed and attached to a proximal side pinch seal part of a discharge tube and the external conductor top of the waveguide surrounding the first conductor assembly. By the irradiated electromagnetic waves (a high-frequency electric field generated by the electromagnetic wave irradiation part), high-density plasma is generated inside the discharge space and a light emission substance of the inside of the discharge space is evaporated and excited and emits light.

Since electromagnetic waves transmitted by the waveguide are guided to the discharge space through the first conductor assembly sealed and attached to the proximal side pinch seal part of the discharge tube, as compared with the conventional structure of being guided through a quartz glass surface, Joule loss in the electromagnetic wave irradiation part becomes small by the amount of Joule loss by quartz glass and light emission efficiency of the discharge tube increases.

Also, in an ellipse spherical bulged part forming an light emission part, as compared with the conventional bottomed cylindrical shape, the tube wall temperature is kept constant (only a part does not increase to high temperature and the tube wall temperature is smoothed over the whole tube wall) and devitrification or a bulge is suppressed and also the minimum temperature of the tube wall increases and light emission efficiency of the discharge tube improves.

Also, when a conductor assembly (second conductor assembly) is sealed and attached to a distal side pinch seal part of the discharge tube, the second conductor assembly acts as an antenna and a high electric field also concentrates on the periphery of the second conductor assembly, so that an arc converges toward the second conductor assembly and the arc (shape) becomes stable. Particularly, in the case of being used as a light source of an automobile lamp such as a head lamp, a discharge tube is used in a form of horizontal lighting and the arc (shape) becomes stable, so that a shape of the discharge tube can be designed so as to become an optimum shape in which the arc does not make contact with the tube wall and this leads to an improvement in light emission efficiency.

Also, a high-intensity discharge tube (arc tube) widely used as a light source of a head lamp etc. for automobile is constructed in a double end shape in which both ends of a glass tube in which an ellipse spherical bulged part is formed in the middle of a longitudinal direction are pinched and sealed and thereby electrode assemblies are sealed and attached to respective pinch seal parts and the inside of the ellipse spherical bulged part forms discharge space, and a "discharge tube constructed in a double end shape in which both ends of a glass tube in which an ellipse spherical bulged part is formed in the middle of a longitudinal direction are pinched and sealed and thereby a conductor assembly is sealed and attached to at least a proximal side pinch seal part and the inside of the ellipse spherical bulged part forms discharge space" can be manufactured by using manufacturing equipment of this high-intensity discharge tube (arc tube).

In one or more embodiments, the conductor assembly is constructed by linearly connecting and integrating a conductor bar and molybdenum foil in the discharge lamp.

Molybdenum foil compatible with glass (quartz glass) is included in a conductor assembly sealed and attached to a pinch seal part, and a thermal expansion difference between the conductor assembly and a glass (quartz glass) layer in the pinch seal part is accommodated by the molybdenum foil and occurrence of cracking in (the glass layer of) the pinch seal part is suppressed and failure of lighting can be prevented.

Also, a conductor assembly is a good conductor made of metal and as compared with an outside diameter (0.10 to 0.40 mm) of a conductor bar, a thickness of molybdenum foil is about 20 μm and is very thin, so that heat conduction as the whole conductor assembly is suppressed and loss by the heat conduction in the conductor assembly becomes small.

In one or more embodiments, it is constructed so that a part of the conductor assembly sealed and attached to at least the proximal side pinch seal part among a pair of the pinch seal parts protrudes to the inside of the discharge space in the discharge lamp.

Since electromagnetic waves transmitted by the coaxial waveguide are surely guided to the discharge space through the first conductor assembly protruding to the inside of the discharge space, Joule loss in the electromagnetic wave irradiation part becomes smaller and light emission efficiency of the discharge tube increases more.

In one or more embodiments, it is constructed so that a region protruding to the inside of the discharge space of the conductor assembly is surrounded by a ceramic coating or a glass cap part extending from the pinch seal part to which the conductor assembly is sealed and attached in the discharge lamp as claimed in claim 3.

Since the conductor assembly protruding to the inside of the discharge space is covered with a ceramic coating or a glass cap part and is not exposed to the discharge space directly, so that there is no fear that the conductor assembly reacts with an enclosure substance (a metal halide) and material of the conductor assembly is not limited all the more and a light emission substance suitable to improve light emission efficiency of the discharge tube can be enclosed with the discharge space.

In one or more embodiments, it is constructed so that the ellipse spherical bulged part is covered with hermetically sealed space defined by a cylindrical shroud for ultraviolet shielding welded to the pinch seal part in the discharge lamp.

A shroud for covering an ellipse spherical bulged part which is a light emission part has action of blocking ultraviolet rays of a wavelength range harmful to the human body. Also, the hermetically sealed space defined by the shroud acts as an insulation layer of the periphery of the ellipse spherical bulged part, and heat dissipation from the ellipse spherical bulged part which is the light emission part to the outside is suppressed.

According to one or more embodiments, a discharge lamp comprising a discharge tube in which light emission efficiency is improved can be provided.

Also, a discharge tube for emitting light of discharge by plasma generated by electromagnetic waves can be simply manufactured without separately developing new manufacturing equipment by applying the manufacturing equipment of a high-intensity discharge tube (arc tube) widely used as a light source of a head lamp etc. for automobiles.

According one or more embodiments, loss by heat conduction in a conductor assembly becomes small, so that a discharge lamp comprising a discharge tube in which light emission efficiency is more surely improved and durability is also good can be provided.

According to one or more embodiments, a discharge lamp comprising a discharge tube in which light emission efficiency is more improved can be provided.

According to one or more embodiments, material of a conductor assembly is not limited all the more and a light emission substance suitable to improve light emission efficiency can also be used, so that a discharge lamp comprising a discharge tube in which light emission efficiency is further improved can be provided.

According to one or more embodiments, a temperature of the inside of discharge space of a discharge tube is held at high temperature, so that a discharge lamp comprising a discharge tube in which light emission efficiency is furthermore improved can be provided.

Other aspects and advantages of the invention will be apparent from the following description and the appended claims.

BRIEF DESCRIPTION OF DRAWINGS

FIG. 1(*a*) is an enlarged perspective view of fixing and holding means of a discharge tube which is a main part of the same discharge lamp.

FIG. 7 is longitudinal sectional views of discharge tubes which are main parts of discharge lamps which are other embodiments of the invention, and 7(*a*) is a longitudinal sectional view of a discharge tube of a third embodiment, and 7(*b*) is a longitudinal sectional view of a discharge tube of a fourth embodiment, and 7(*c*) is a longitudinal sectional view of a discharge tube of a fifth embodiment, and 7(*d*) is a longitudinal sectional view of a discharge tube of a sixth embodiment, and 7(*e*) is a longitudinal sectional view of a discharge tube of a seventh embodiment, and 7(*f*) is a longitudinal sectional view of a discharge tube of an eighth embodiment.

FIG. 8 is an explanatory view explaining a process of covering a conductor bar protruding to discharge space with a cap part.

FIG. 9 is a diagram showing a lighting test result.

FIG. 11 is a diagram showing a tube wall load test on a discharge valve in the first embodiment.

FIG. 12 is a diagram showing an electrode damage test on the discharge valve in the first embodiment.

DETAILED DESCRIPTION

Next, embodiments of the invention will be described based on examples.

Figure 1:
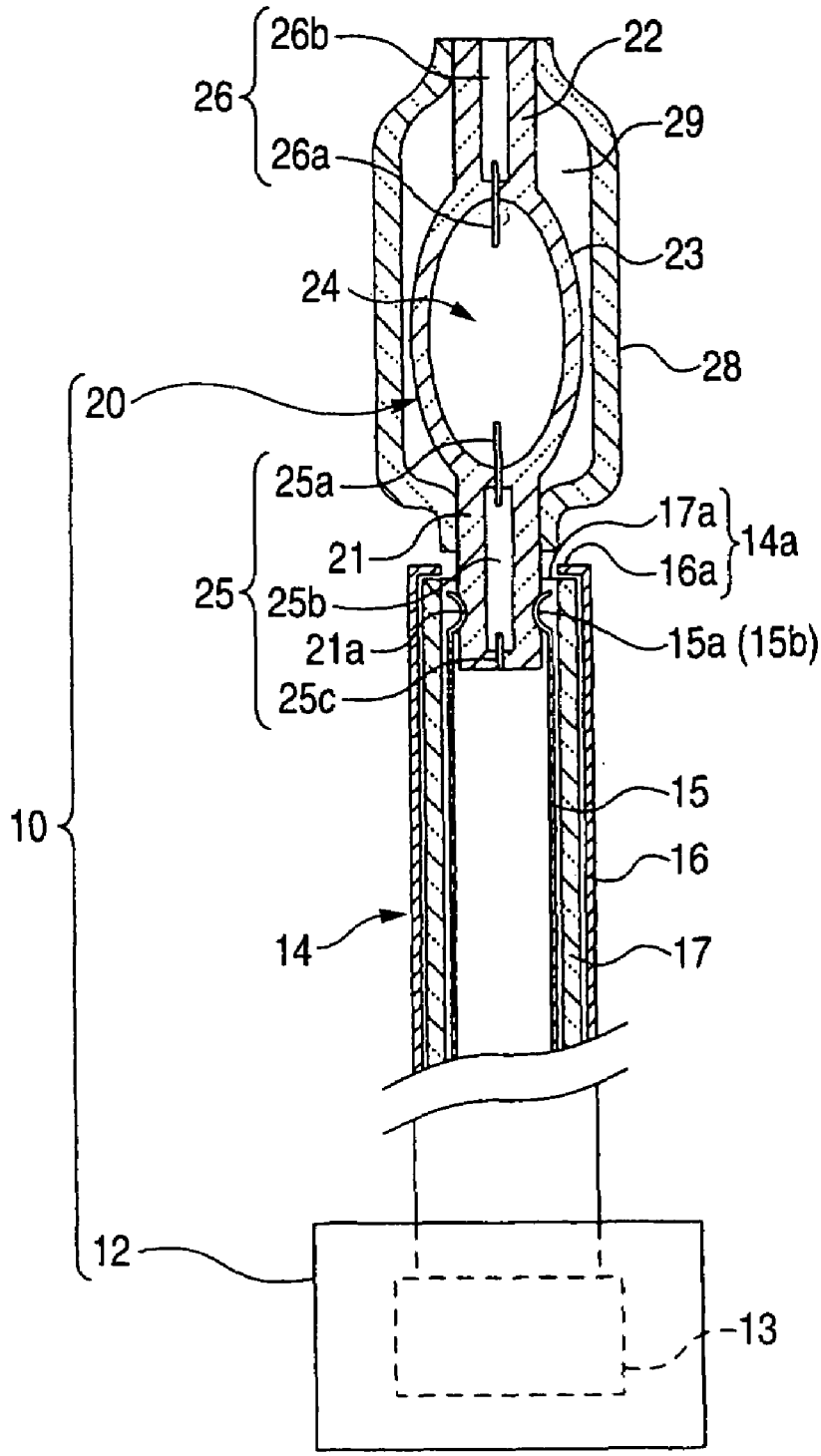
FIG. 1 is a longitudinal sectional view showing an outline of a discharge lamp which is a first embodiment of the invention.
Figure 1:
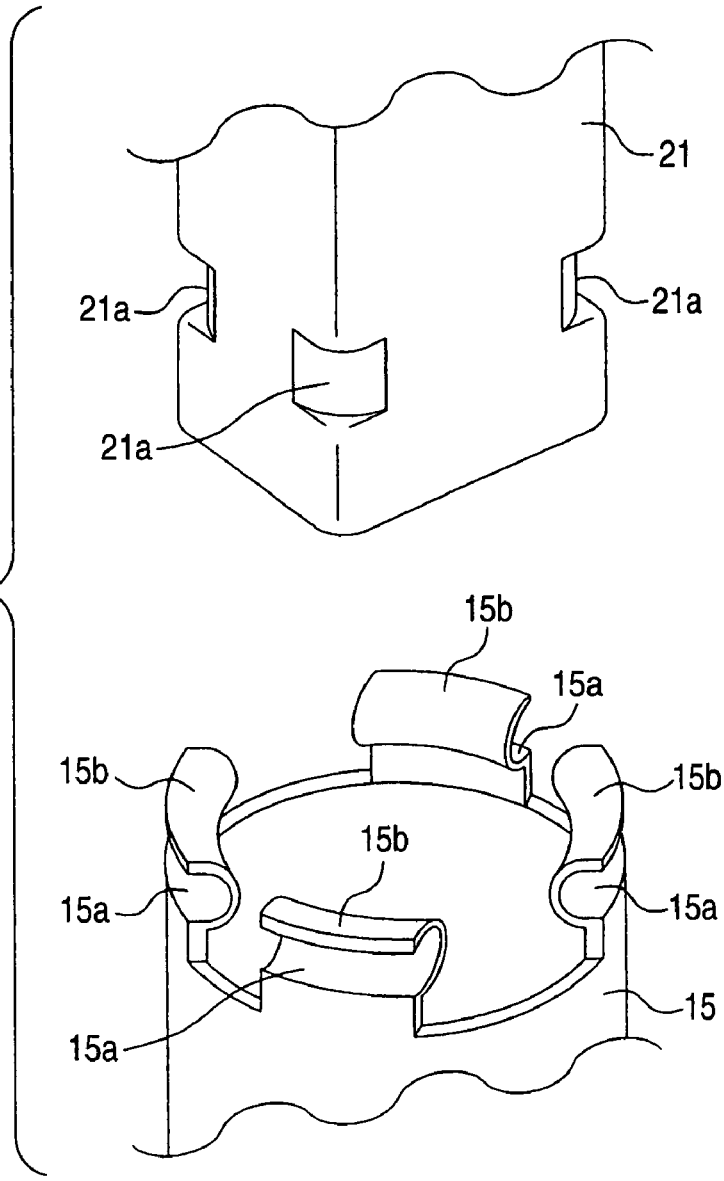

FIGS. 1 and 1(*a*) show a discharge lamp which is a first embodiment of the invention, and FIG. 1 is a longitudinal sectional view showing an outline of the same discharge lamp, and FIG. 1(*a*) is an enlarged perspective view of discharge tube fixing and holding means which is a main part of the same discharge lamp.

In FIG. 1, a discharge lamp 10 comprises a power source part 12 for generating high-frequency electromagnetic waves, a waveguide 14 for transmitting the electromagnetic waves generated by the power source part 12, and a discharge tube 20 for emitting light of discharge by the electromagnetic waves transmitted by the waveguide 14.

The power source part 12 comprises a sending part 13 for generating electromagnetic waves of a microwave band (1 to 100 GHz) by electric power supplied from a vehicle-mounted battery, and the sending part 13 is constructed of a high-frequency amplifier using, for example, a magnetron or a semiconductor switching element (an FET, a bipolar transistor, etc.).

The waveguide 14 has a structure in which a circular pipe-shaped internal conductor 15 made of metal, a circular pipe-shaped external conductor 16 made of metal surrounding this internal conductor 15 and a dielectric 17 made of quartz glass which is an insulating member interposed between both the conductors 15, 16 and is formed in a circular pipe shape are coaxially integrated, and electromagnetic waves are transmitted between the internal conductor 15 and the external conductor 16 surrounding this internal conductor.

The discharge tube 20 is constructed in a double end shape in which both ends of a glass (anhydrous quartz glass) tube in which an ellipse spherical bulged part 23 is formed in the middle of a longitudinal direction are pinched and sealed and thereby conductor assemblies 25, 26 are sealed and attached to pinch seal parts 21, 22 and the inside of the ellipse spherical bulged part 23 forms discharge space 24.

A rare gas (1 to 20 atmospheric pressures at room temperature) for starting together with a light emission substance (NaI, $ScI_3$, etc.) are enclosed with the inside of the ellipse spherical bulged part 23 (discharge space 24) of the discharge tube 20, and the conductor assembly 25 in which a tungsten-made conductor bar 25*a* and a molybdenum-made conductor bar 25*c* are linearly connected and integrated through rectangular molybdenum foil 25*b* is sealed and attached to the proximal side pinch seal part 21. The tungsten-made conductor bar 25*a* protrudes to the inside of the discharge space 24 by a predetermined length and the molybdenum-made conductor bar 25*c* is exposed flush with a top surface of the pinch seal part 21. On the other hand, the conductor assembly 26 in which a tungsten-made conductor bar 26*a* and rectangular molybdenum foil 26*b* are linearly connected and integrated is sealed and attached to the distal side pinch seal part 22 of the discharge tube 20, and the tungsten-made conductor bar 26*a* protrudes to the inside of the discharge space 24 by a predetermined length (the same length as the protrusion length of the conductor bar 25*a*) and the molybdenum foil 26*b* is exposed flush with a top surface of the pinch seal part 22.

The tungsten-made conductor bars 25*a*, 26*a* constructing the conductor assemblies 25, 26 are constructed of, for example, a thoria-doped tungsten wire or a potassium-doped tungsten wire with an outside diameter of 0.25 mm, and the molybdenum foils 25*b*, 26*b* are formed in, for example, a thickness of 20 μm. The molybdenum foils 25*b*, 26*b* are compatible with glass and a thermal expansion difference between the conductor assemblies 25, 26 and a glass (quartz glass) layer in the pinch seal parts 21, 22 is accommodated by the molybdenum foils 25*b*, 26*b* and occurrence of cracking in (the glass layer of) the pinch seal parts 21, 22 is suppressed and lighting failure can be prevented.

Also, transverse sectional areas of the molybdenum foils 25*b*, 26*b* are smaller than transverse sectional areas of the tungsten-made conductor bars 25*a*, 26*a*, so that heat conduction as the whole of the conductor assemblies 25, 26 is suppressed and loss by the heat conduction in the conductor assemblies 25, 26 is small.

In addition, it is desirable that a thickness (outside diameter) of the tungsten-made conductor bars 25*a*, 26*a* be in the range from 0.10 to 0.40 mm, and it is checked that light emission efficiency of the discharge tube 20 is higher as the thickness (outside diameter) becomes thin (small).

Also, in one or more embodiments, the discharge tube 20 is lit using lighting electric power of 30 W, and it is checked that light emission efficiency similar to that of the present embodiment can be obtained by increasing the ellipse spherical bulged part 23 of the discharge tube 20 (increasing the cubic capacity of the discharge space 24) in the case of increasing the lighting electric power.

The discharge tube 20 is surrounded by a cylindrical shroud 28 for ultraviolet shielding whose ends are welded to the pinch seal parts 21, 22. The shroud 28 is constructed of quartz glass to which metal such as titanium having action of blocking ultraviolet rays of a wavelength range harmful to the human body is added, and has action of blocking ultraviolet rays harmful to the human body included in discharge light emission of the discharge tube 20. That is, when the discharge tube 20 attempts to be constructed of quartz glass to which metal having ultraviolet blocking action is added, a processing temperature of a glass tube increases or the discharge tube cannot be used because of a reaction (influence on light emission) between the added metal and an enclosure substance, and the discharge tube 20 is constructed of anhydrous quartz glass without the ultraviolet blocking action. Then, the ellipse spherical bulged part 23 of the discharge tube 20 is constructed so as to be covered with the shroud 28 for ultraviolet shielding in order to avoid an adverse influence on the human body or damage to a resin-made lamp component by radiation of ultraviolet rays. Also, it is useful to add alumina ($Al_2O_3$) to quartz glass constructing the shroud 28 in order to prevent a deterioration of life performance characteristics by Na leakage.

Also, the inside of the shroud 28 (the periphery of the discharge tube 20) is constructed so that light emission efficiency of the discharge tube 20 improves by forming hermetically sealed space 29 filled with an inert gas or vacuumized and suppressing heat dissipation from the discharge tube 20 by the hermetically sealed space 29 which is a heat insulation layer. In addition, the inert gas etc. enclosed with the inside of the shroud 28 (hermetically sealed space 29) are preferably a substance with heat insulation properties higher than those of air and, for example, the cases of enclosing a single gas of $N_2$, Xe or Ar or enclosing a mixed gas such as $N_2$+Ar, $N_2$+Xe or Ar+Ne are contemplated. Also, the inert gas etc. enclosed with the inside of the shroud 28 (hermetically sealed space 29) act as an auxiliary gas for starting and are effective in improving starting performance (early lighting).

Also, an opening 14*a* in which the proximal side pinch seal part 21 of the discharge tube 20 can be inserted and held is disposed in the top of the waveguide 14. The opening 14*a* is constructed of an annular front edge part 16*a* of the circular pipe-shaped external conductor 16 and a top opening 17*a* of the circular pipe-shaped dielectric 17, and tongue-shaped pinch pieces 15*a* which are discharge tube fixing and holding means disposed in the top of the circular pipe-shaped internal conductor 15 are arranged inside the circular pipe-shaped dielectric 17. That is, as shown in FIG. 1(*a*), while circular arc-shaped recessed grooves 21*a* are formed in four corners of the rectangular proximal side pinch seal part 21 in the discharge tube 20, four tongue-shaped pinch pieces 15*a* are formed in the top of the circular pipe-shaped internal conductor 15 as opposed to four corners of the pinch seal part 21 and also circular arc-shaped latch parts 15*b* capable of engaging with the recessed grooves 21*a* of the pinch seal part 21 are formed in the top sides of the pinch pieces 15*a*.

Then, when the proximal side pinch seal part 21 of the discharge tube 20 is inserted in the top opening 14*a* of the waveguide 14 (the top opening 17*a* of the dielectric 17), it is constructed so that the top of the proximal side pinch seal part 21 is inserted with the tongue-shaped pinch pieces 15*a* of the internal conductor 15 pushed and the latch parts 15*b* of the tongue-shaped pinch pieces 15*a* engage with the recessed grooves 21*a* of the pinch seal part 21 and thereby the pinch seal part 21 is gripped (pinched) in the tongue-shaped pinch pieces 15*a* and is positioned and fixed and held in axial and circumferential directions (the discharge tube 20 is retained and fixed and held in the top opening 14*a* of the waveguide 14) and also the pinch seal part 21 is retained and fixed and held in the top opening 14*a* of the waveguide 14 and also the conductor assembly 25 (molybdenum-made conductor bar 25*c*) approaches the internal conductor 15.

As a result of this, the inside of the discharge space 24 is irradiated with high-frequency electromagnetic waves transmitted by the waveguide 14 by the conductor assembly 25 sealed and attached to the proximal side pinch seal part 21 and the annular front edge part 16*a* of the external conductor 16 surrounding this conductor assembly 25. At this time, by the irradiated electromagnetic waves (a high-frequency electric field generated by an electromagnetic wave irradiation part), high-density plasma is generated inside the discharge space 24 and a light emission substance of the inside of the discharge space 24 is evaporated and excited and emits light. That is, the electromagnetic wave irradiation part for irradiating the discharge space 24 with electromagnetic waves is constructed by the conductor assembly 25 and the annular front edge part 16*a* of the external conductor 16 surrounding this conductor assembly 25, and the top of the waveguide 14 functions as a launcher for guiding electromagnetic waves to the discharge tube 20.

Particularly, the tungsten-made conductor bar 25*a* of the conductor assembly 25 constructing the electromagnetic wave irradiation part protrudes to the inside of the discharge space 24, so that electromagnetic waves transmitted by the waveguide 14 are naturally guided to the inside of the discharge space 24 surely through the conductor bar 25*a* and as compared with the case of guiding electromagnetic waves through a quartz glass surface as shown in the conventional art, there is no Joule loss by quartz glass, so that the Joule loss in the electromagnetic wave irradiation part is small and light emission efficiency of the discharge tube 20 improves accordingly.

Also, the second conductor assembly 26 sealed and attached to the distal side pinch seal part 22 of the discharge tube 20 acts as an antenna and a high electric field also concentrates on the periphery of the second conductor assembly 26, so that an arc becomes stable. Also, when the arc becomes stable, a shape of the discharge tube 20 can be optimized, so that it leads to an improvement in light emission efficiency.

Figure 14:
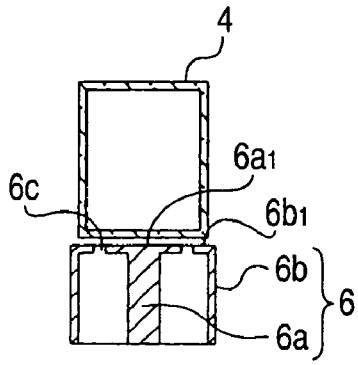
FIG. 14 is a longitudinal sectional view of a discharge tube which is a main part of the same discharge lamp.

Also, in one or more embodiments, the proximal side pinch seal part 21 of the discharge tube 20 is attached to the top of the waveguide 14, and an area of contact between the discharge tube 20 and the waveguide 14 is limited to a pinch (grip) region by the tongue-shaped pinch pieces 15*a* which are the fixing and holding means among the outer periphery of the pinch seal part 21, so that the area of contact is smaller than that of the conventional structure and loss by heat conduction is small. Further, a surface area of the ellipse spherical bulged part 23 forming a light emission part of the discharge tube is smaller than that of the conventional bottomed cylindrical body (see FIG. 14) and loss of heat radiation from a tube wall is small, so that light emission efficiency of the discharge tube 20 increases.

Also, in the ellipse spherical bulged part 23 forming the light emission part, as compared with the conventional bottomed cylindrical shape, the tube wall temperature is kept constant (only a part does not increase to high temperature and the tube wall temperature is smoothed over the whole tube wall) and devitrification or a bulge is suppressed and also the minimum temperature of the tube wall increases and light emission efficiency of the discharge tube 20 improves.

Figure 2:
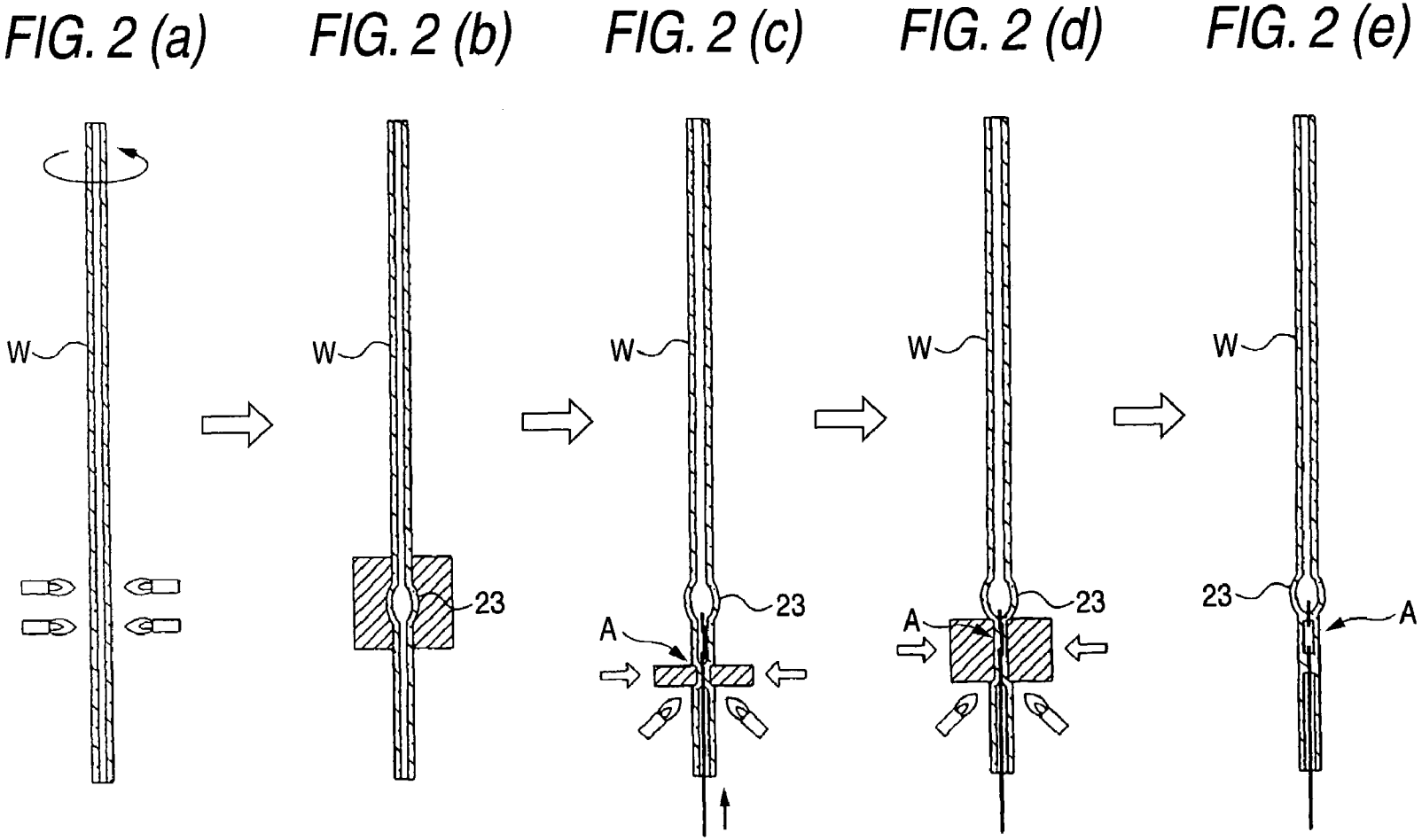
FIG. 2 is views explaining the first half of a manufacturing process of a discharge tube, and 2(*a*) and 2(*b*) are views showing a process of molding an ellipse spherical bulged part, and 2(*c*) and 2(*d*) are views showing a primary pinch seal process, and 2(*e*) is a sectional view of a glass tube through the primary pinch seal process.
Figure 3:
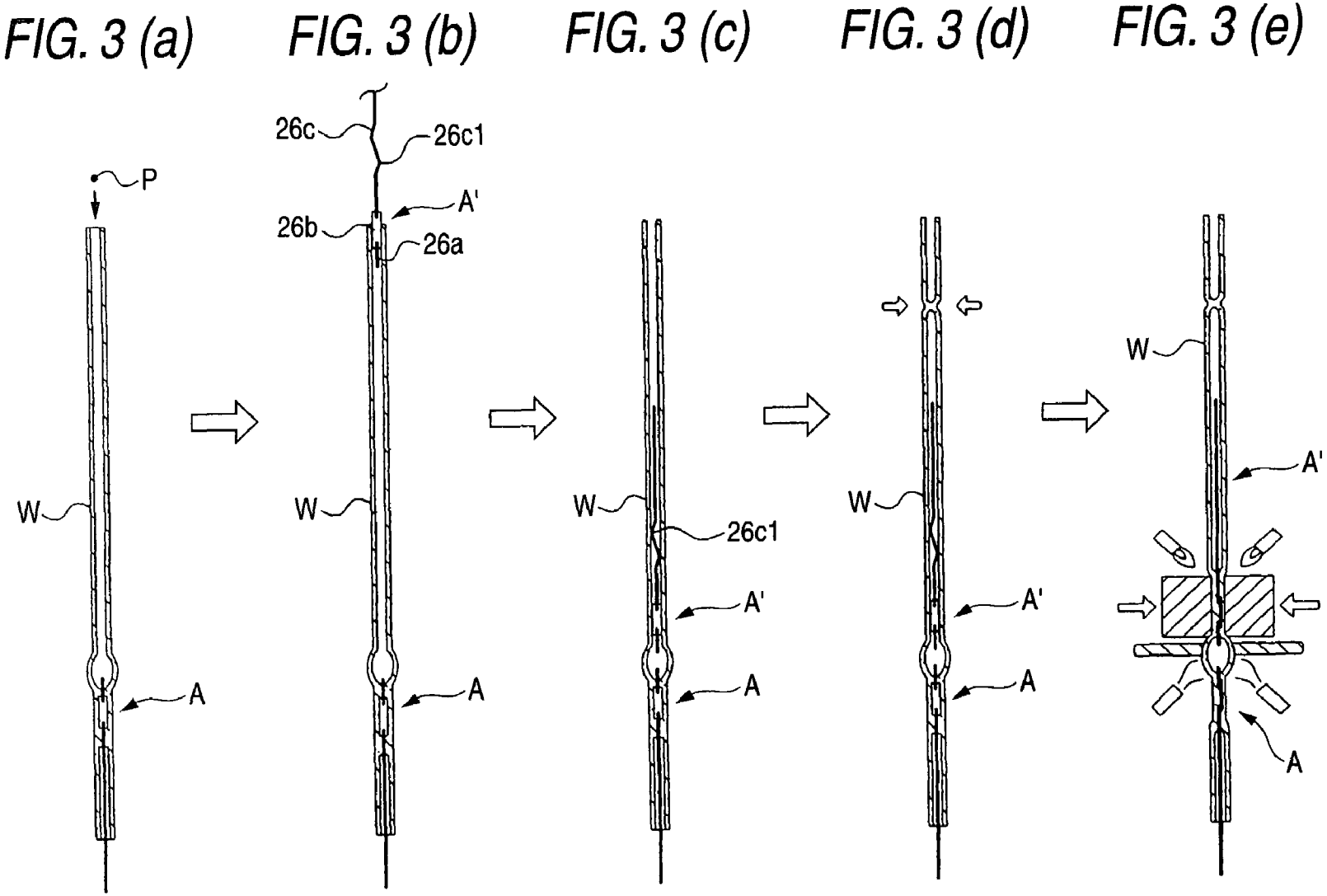
FIG. 3 is views explaining the second half of the manufacturing process of the discharge tube, and 3(*a*) is a view showing a pellet supply process, and 3(*b*) and 3(*c*) are views showing a conductor assembly insertion process, and 3(*d*) is a view showing a glass tube temporary seal process, and 3(*e*) is a view showing a secondary pinch seal process.
Figure 4:
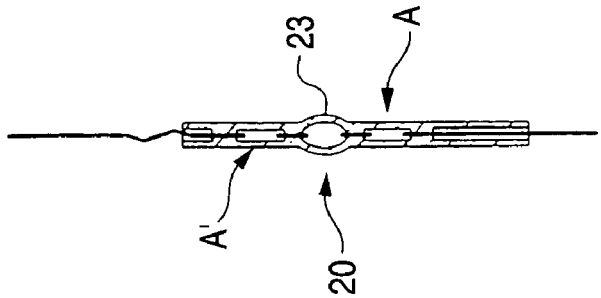
FIG. 4 is views explaining a shroud tube welding process, and 4(*a*) is a sectional view of the discharge tube before welding of the shroud tube, and 4(*b*) and 4(*c*) are views showing the shroud tube welding process.
Figure 4:
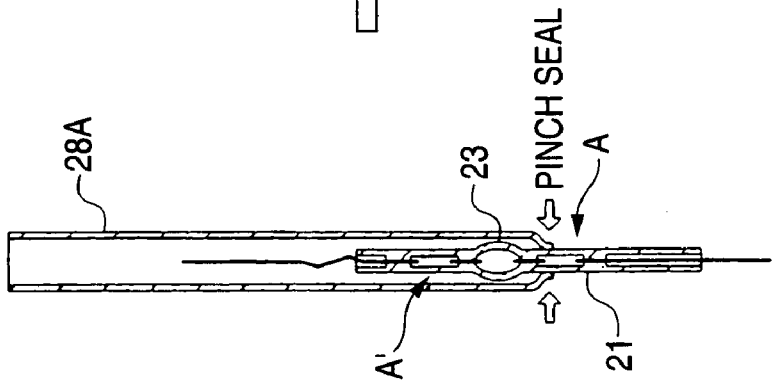
Figure 4:
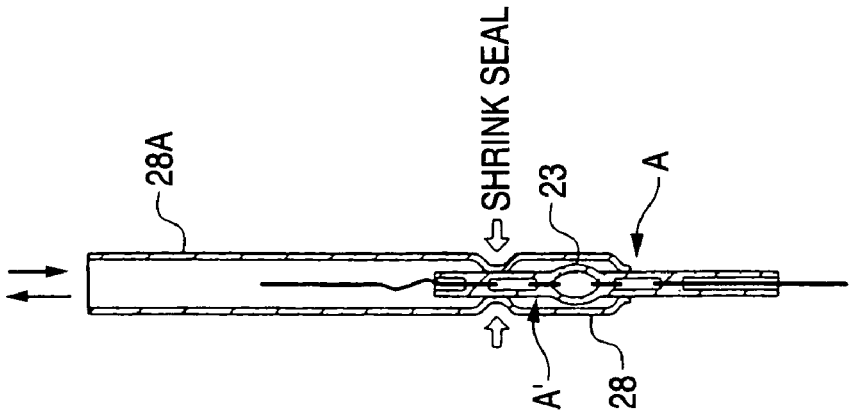

FIGS. 2 to 4 are process explanatory diagrams showing a welding process of a shroud and manufacture of the discharge tube 20. In JP-A-2002-163980, JP-A-2005-327487, etc., a welding process of a shroud and a manufacturing process of a high-intensity discharge tube (arc tube) widely used as a light source of a head lamp etc. for automobile are disclosed, that is, the process of manufacturing a high-intensity discharge tube (arc tube) with a double end shape in which both ends of a glass tube in which an ellipse spherical bulged part is formed in the middle of a longitudinal direction are pinched and sealed and thereby electrode assemblies are sealed and attached to respective pinch seal parts and the inside of the ellipse spherical bulged part forms discharge space and further welding a shroud to the pinch seal parts of the high-intensity discharge tube (arc tube) so as to surround this high-intensity discharge tube (arc tube) is disclosed, and the welding process of the shroud and manufacture of the discharge tube 20 shown in FIGS. 2 to 4 is a manufacturing method using manufacturing equipment of this high-intensity discharge tube (arc tube).

First, as shown in FIGS. 2(*a*) and 2(*b*), a glass tube W is heated by a burner and an ellipse spherical bulged part 23 is molded by blow molding in a predetermined position of a longitudinal direction of the glass tube. Next, as shown in FIGS. 2(*c*) and 2(*d*), a conductor assembly A in which a tungsten-made conductor bar 25*a*, molybdenum foil 25*b* and a molybdenum-made conductor bar 26*c* are linearly connected and integrated is inserted into the glass tube W and is held in a predetermined position and is heated by the burner and a position of the vicinity of the ellipse spherical bulged part 23 is pinched and sealed (primarily pinched and sealed). Specifically, the glass tube W to which the conductor assembly A is sealed and attached is completed by performing the temporary pinch seal shown in FIG. 2(*c*) followed by the main pinch seal shown in FIG. 2(*d*) (see FIG. 2(*e*)).

Then, as shown in FIG. 3(*a*), a pellet P of a light emission substance etc. is introduced into the glass tube W and further as shown in FIGS. 3(*b*) and 3(*c*), a conductor assembly A' in which a tungsten-made conductor bar 26*a*, molybdenum foil 26*b* and a molybdenum-made conductor bar 26*c* are linearly connected and integrated is inserted into the glass tube W and is held in a predetermined position. The molybdenum-made conductor bar 26*c* is provided with a bend part 26*c*1 with a width larger than an inside diameter of the glass tube W and the bend part 26*c*1 makes pressure contact with an inner peripheral surface of the glass tube W and thereby the conductor assembly A' is self-held in a predetermined position of the inside of the glass tube W. Then, as shown in FIG. 3(*d*), the light emission substance etc. are sealed inside the tube W by chipping off the glass tube W in a predetermined position while supplying a xenon gas to the inside of the glass tube W. Then, as shown in FIG. 3(*e*), while the ellipse spherical bulged part 23 is cooled by liquid nitrogen and the light emission substance etc. which are an enclosure substance are condensed and the inside of the tube is held at a negative pressure, a position of the vicinity of the ellipse spherical bulged part 23 is pinched and sealed (secondarily pinched and sealed) and the inside of the ellipse spherical bulged part 23 is sealed.

Then, a discharge tube 20 is completed by cutting the glass tube W in a predetermined position (see FIG. 4(*a*)). Then, as shown in FIG. 4(*b*), the discharge tube 20 is inserted into a shroud tube 28A and the back end (lower end) of the shroud tube 28A is heated by the burner and is welded to a pinch seal part 21. Then, as shown in FIG. 4(*c*), after performing gas replacement for exhausting air from the inside of the shroud tube 28A and supplying a dry inert gas, a predetermined position of the shroud tube 28A is heated by the burner and is shrunk and sealed. Finally, the discharge tube 20 (see FIG. 1) into which a shroud 28 is integrated is completed by cutting the discharge tube 20 into which the shroud tube 28A is integrated in a predetermined position.

Figure 5:
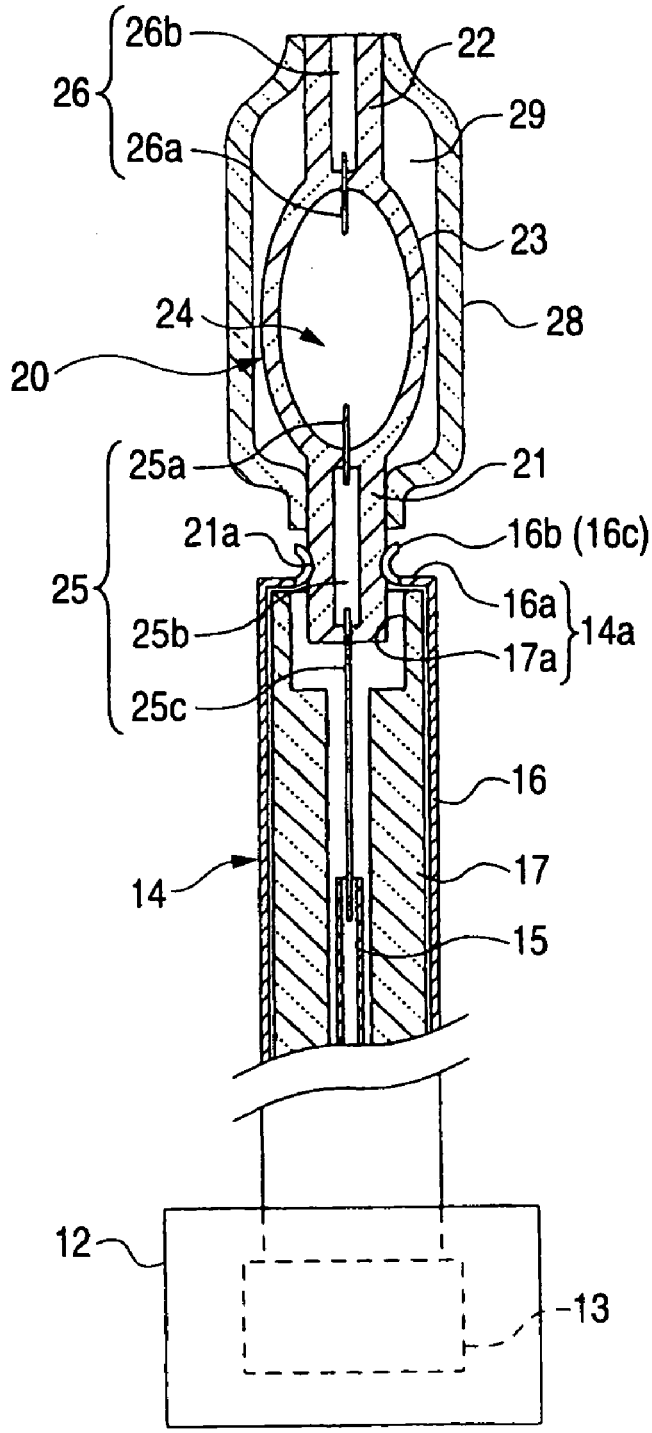
FIG. 5 is a longitudinal sectional view showing an outline of a discharge lamp which is a second embodiment of the invention.

FIG. 5 is a longitudinal sectional view showing an outline of a discharge lamp which is a second embodiment of the invention.

In the first embodiment described above, the molybdenum-made conductor bar 25*c* is exposed flush with an end face of the proximal side pinch seal part 21 of the discharge tube 20, but this second embodiment has a structure in which a molybdenum-made conductor bar 25*c* straight extends from a proximal side pinch seal part 21 of a discharge tube 20A.

Also, in a circular pipe-shaped dielectric 17, an opening 17*a* for engagement with the proximal side pinch seal part 21 of the discharge tube 20A is formed in the top of the dielectric 17 and also an internal conductor 15 disposed inside the dielectric 17 is formed in a circular pipe shape having an inside diameter of a size capable of inserting the molybdenum-made conductor bar 25*c*.

Also, four tongue-shaped pinch pieces 16*b* which are discharge tube fixing and holding means with a structure similar to that of the tongue-shaped pinch pieces 15*a* formed in the top of the internal conductor 15 in the first embodiment are formed in the top of an external conductor 16 of a waveguide 14. That is, circular arc-shaped latch parts 16*c* capable of engaging with recessed grooves 21*a* of the pinch seal part 21 are formed in the four tongue-shaped pinch pieces 16*b* disposed as opposed to four corners of a pinch seal part 22.

Then, when the proximal side pinch seal part 21 of the discharge tube 20 is inserted in a top opening 14*a* of the waveguide 14 (the top opening 17*a* of the dielectric 17) so as to push the tongue-shaped pinch pieces 16*b*, it is constructed so that the latch parts 16*c* of the tongue-shaped pinch pieces 16*b* engage with the recessed grooves 21*a* of the pinch seal part 21 and thereby the pinch seal part 21 is retained and fixed and held in the top opening 14*a* of the waveguide 14 and also the top of the molybdenum-made conductor bar 25*c* extending from the proximal side pinch seal part 21 is inserted into the circular pipe-shaped internal conductor 15 disposed inside the dielectric 17 and approaches the internal conductor 15.

The others are the same as the first embodiment and the overlap description is omitted by assigning the same numerals.

Figure 6:
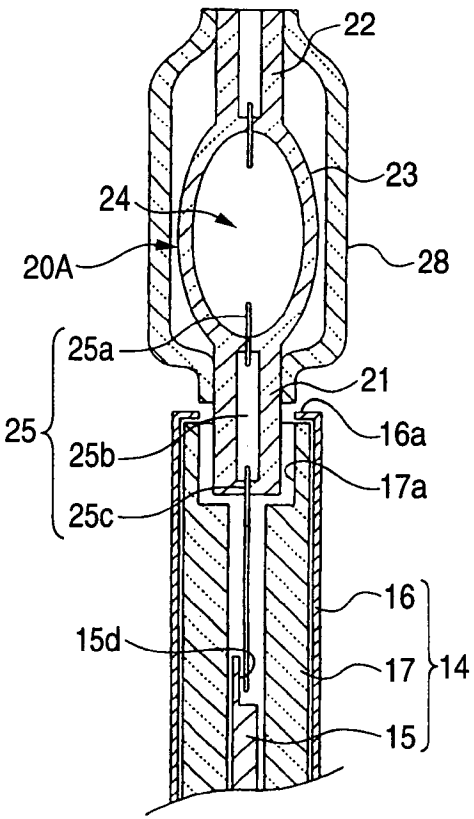
FIG. 6 is a longitudinal sectional view showing a modified example of an internal conductor constructing a waveguide of the same discharge lamp.
Figure 6:
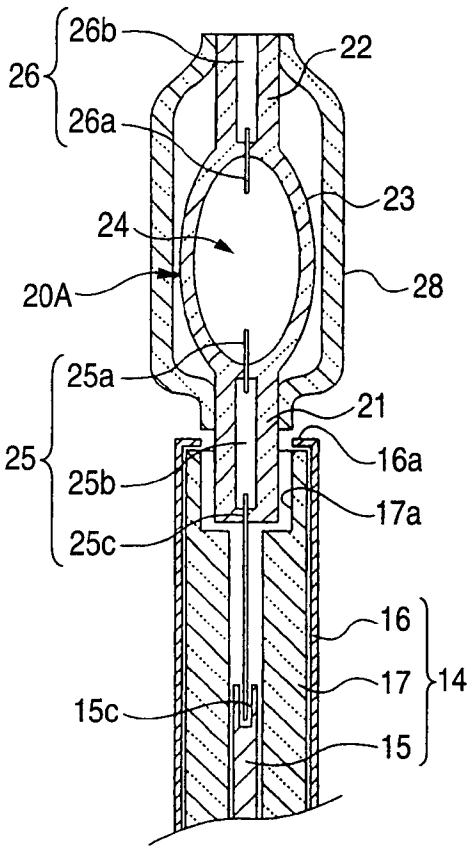

Also, in this second embodiment, the internal conductor 15 constructing the waveguide 14 is constructed in a circular pipe shape, but a configuration in which the internal conductor 15 is constructed of a bar-shaped or linear solid body and the top of the solid body is provided with a hole 15*c* capable of inserting the top of the molybdenum-made conductor bar 25*c* extending from the proximal side pinch seal part 21 as shown in FIG. 6(*a*) or a configuration in which the internal conductor 15 is constructed of a bar-shaped or linear solid body and the side of the solid body is provided with a notch 15*d* capable of closely arranging the top of the molybdenum-made conductor bar 25*c* extending from the proximal side pinch seal part 21 as shown in FIG. 6(*b*) may be used. In addition, illustration of the tongue-shaped pinch pieces 16*b* which are discharge tube fixing and holding means disposed in the top of the waveguide 14 (external conductor 16) is omitted in FIGS. 6(*a*) and 6(*b*).

FIG. 7 is a longitudinal sectional view of a discharge tube which is a main part of a discharge lamp which is other embodiments of the invention. A discharge tube 20B in a third embodiment shown in FIG. 7(*a*) has a structure in which the proximal side pinch seal part 21 and the distal side pinch seal part 22 of the discharge tube 20A in the second embodiment are reversed and the pinch seal part is inserted and held in a top opening 14*a* of a waveguide 14 (a top opening 17*a* of a dielectric 17).

Also, a tungsten-made conductor bar 26*a* of the side of the distal side pinch seal part protruding to the inside of discharge space 24 is covered with a glass cap part 27 extending from the pinch seal part 22. In addition, the tungsten-made conductor bar 26*a* may be covered with a ceramic coating ($Al_2O_3$, $SiO_2$, etc.) rather than the glass cap part.

In a discharge tube 20C in a fourth embodiment shown in FIG. 7(*b*), a tungsten-made conductor bar 25*a* of a proximal side conductor assembly 25 in the discharge tube 20A of the second embodiment is covered with a glass cap part 27 extending from a pinch seal part 21. That is, the discharge tube 20C has a structure in which the proximal side pinch seal part 21 and the distal side pinch seal part 22 of the discharge tube 20B in the third embodiment are reversed and the pinch seal part is inserted and held in a top opening 14*a* of a waveguide 14 (a top opening 17*a* of a dielectric 17).

In a discharge tube 20D in a fifth embodiment shown in FIG. 7(*c*), tungsten-made conductor bars 25*a*, 26*a* protruding to the inside of discharge space 24 of conductor assemblies 25, 26 sealed and attached to pinch seal parts 21, 22 are respectively covered with glass cap parts 27.

Discharge tubes 20E, 20F in sixth and seventh embodiments shown in FIGS. 7(*d*) and 7(*e*) have a structure in which a conductor assembly 26 is not sealed and attached to a distal side pinch seal part 22.

A discharge tube 20G in an eighth embodiment shown in FIG. 7(*f*) has a structure in which conductor assemblies 25, 26 are respectively sealed and attached to a proximal side pinch seal part 21 and a distal side pinch seal part 22 but respective conductor bars 25*a*, 26*a* are not exposed to the inside of discharge space 24 at all and do not protrude naturally. Therefore, the conductor bars 25*a*, 26*a* may be constructed of molybdenum compatible with glass instead of tungsten.

Also, the distal side conductor bar 26*a* of the discharge tube 20B in the third embodiment (see FIG. 7(*a*)), the proximal side conductor bar 25*a* of the discharge space 24 of the discharge tube 20C in the fourth embodiment (see FIG. 7(*b*)), the proximal side conductor bar 25*a* and the distal side conductor bar 26*a* of the discharge tube 20D in the fifth embodiment (see FIG. 7(*c*)), and the proximal side conductor bar 25*a* of the discharge tube 20E in the sixth embodiment (see FIG. 7(*d*)) are respectively covered with the glass cap parts 27 integrally formed with the discharge tubes and are not exposed to the inside of discharge space 24 directly, so that it is unnecessary to consider a reaction between the conductor bars 25*a*, 26*a* and an enclosure substance (for example, a metal halide) of the inside of the discharge space 24 and these conductor bars 25*a*, 26*a* may be constructed of molybdenum rather than tungsten.

Particularly, in the discharge tube 20D in the fifth embodiment (see FIG. 7(*c*)) and the discharge tube 20E in the sixth embodiment (see FIG. 7(*d*)), the conductor bars 25*a*, 26*a* and the discharge space 24 are surely blocked by the glass cap part 27, so that a desired substance such as a metal halide more effective in increasing light emission efficiency can be enclosed with the discharge space 24.

In addition, in order to obtain a structure in which the tungsten-made conductor bars 25*a*, 26*a* are covered with the cap part 27, the glass cap part 27 is welded in the pinch seal process shown in FIGS. 2(*d*) and 3(*e*). For example, in the primary pinch seal process, it is constructed so that the tungsten-made conductor bar 25*a* of the conductor assembly A inserted into the glass tube W is previously covered with a glass cap 27A and the conductor assembly A covered with the cap 27A is inserted into the glass tube W and is held in a predetermined position and the glass tube W together with the proximal side of the cap 27A are pinched and sealed as shown in FIG. 8. In addition, in the secondary pinch seal process of inserting the conductor assembly A' in the glass tube W with the tungsten-made conductor bar 26*a* directed downward, prevention of a drop of the covered cap 27A from the conductor bar 26*a* is required but; for example, the drop prevention can be solved by slightly bending the tungsten-made conductor bar 26*a* covered with the cap 27A. In addition, when a ceramic coating is formed on outer surfaces of the conductor bars 25*a*, 26*a*, the need for a troublesome process (see FIG. 8) of pinching and sealing in a state of covering the conductor bars 25*a*, 26*a* with the cap 27A is eliminated.

Figure 10:
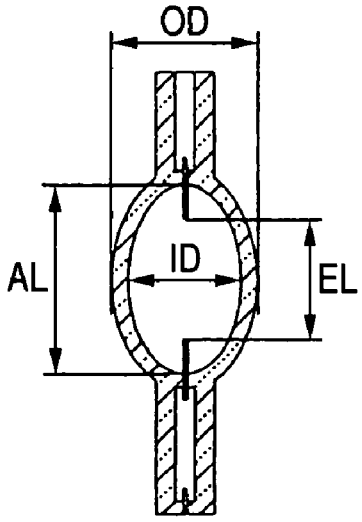
FIG. 10 is views explaining specifications of a discharge tube used in a lighting test.
Figure 10:
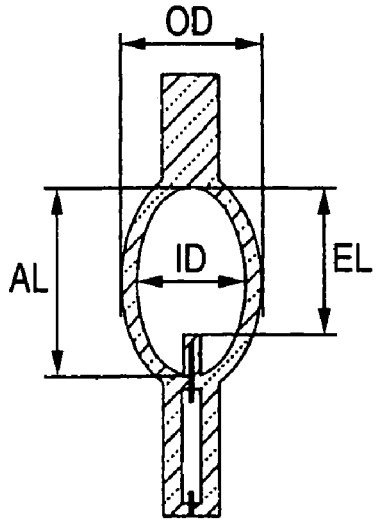
Figure 13:
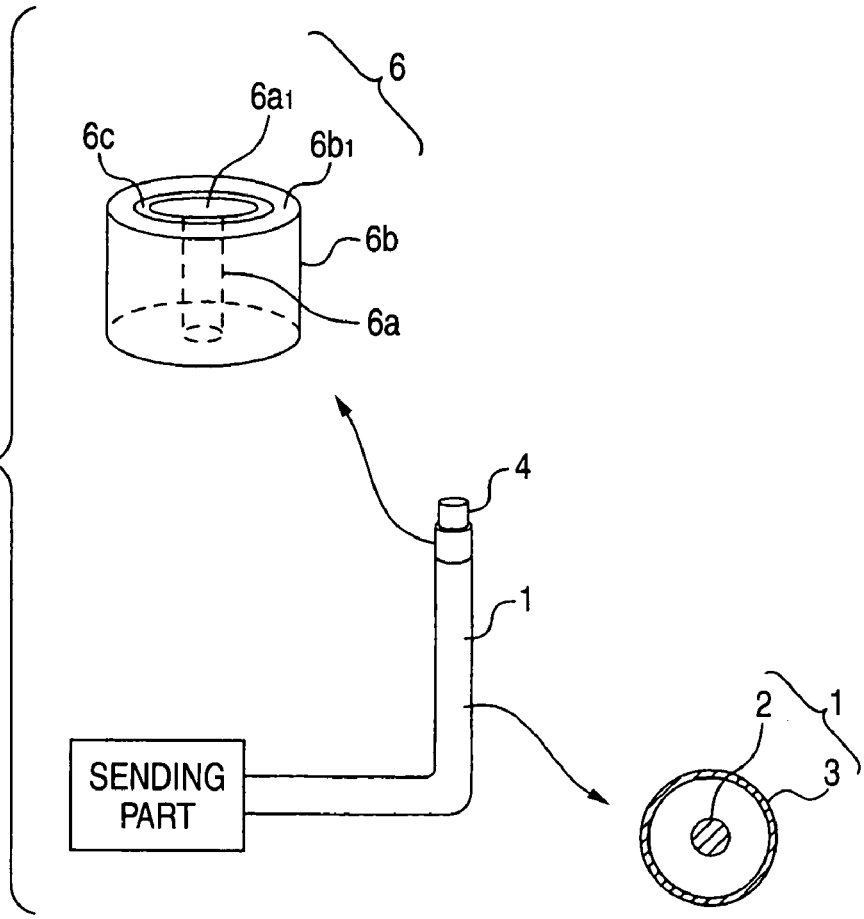
FIG. 13 is the whole configuration diagram of a conventional discharge lamp.

FIG. 9 is a diagram showing specifications, luminous flux and efficiency of the respective discharge tubes in the first embodiment (see FIG. 1), the fifth embodiment (see FIG. 7(*c*)) to the seventh embodiment (see FIG. 7(*e*)) as experiment results. However, AL is a major axis of ellipse spherical discharge space 24 and EL is a distance between conductor bars 25*a*, 26*a* or a distance between a cap part 27 and a pinch seal part opposite to the cap part and ID is a minor axis of the ellipse spherical discharge space 24 and OD is the maximum outside diameter of an ellipse spherical bulged part as shown in FIGS. 10(*a*) and 10(*b*).

As can be seen from this FIG. 9, in any of the first embodiment and the fifth to seventh embodiments, 3000 lumens or more can be obtained in luminous flux of the discharge tubes and 100 lumen/watt or more can be obtained in efficiency, so that it is apparent that each of the discharge tubes effectively functions as a light source of a head lamp for automobile.

FIG. 11 is a diagram showing a tube wall load test of a discharge tube, and is data of the case where two kinds of discharge tubes with different sizes of the ellipse spherical bulged part 23 of the discharge tube 20 in the first embodiment (see FIG. 1) are lit using lighting electric powers of 30, 50, 100, 150 W together with a comparative example (a columnar discharge tube). In addition, in FIG. 11, a O mark shows the case where light emission efficiency was good, and a $x_1$ mark shows the case where light emission efficiency was bad, and $x_2$ shows the case where devitrification or a bulge occurs in the discharge tube.

It is apparent from this FIG. 11 that by decreasing a surface area of a wall of the tube, loss of heat radiation from a surface of the tube reduces and also by forming a light emission part in an ellipse spherical shape, a temperature of the whole tube wall is kept more constant and a temperature in a high temperature part of the tube wall reduces and devitrification or a bulge is prevented and also the minimum temperature of the tube wall increases and thereby light emission efficiency improves.

FIG. 12 is a diagram showing a damage test of tungsten conductor bars of a discharge tube, and is data of the case where four kinds of discharge tubes with different thicknesses of the tungsten conductor bars 25*a*, 26*a* protruding to the discharge space of the discharge tube 20 in the first embodiment (see FIG. 1) are lit using lighting electric powers of 30, 50, 100 W. In addition, in FIG. 12, a O mark shows the case where light emission efficiency was good and damage to the tungsten conductor bar was not found, and $x_1$ shows the case where damage to the tungsten conductor bar was found, and $x_2$ shows the case where light emission efficiency was bad.

It is apparent from this FIG. 12 that when thicknesses of the tungsten conductor bars 25*a*, 26*a* are thinned, loss of heat conduction through a conductor assembly reduces and the inside of discharge space is maintained at high temperature accordingly, so that light emission efficiency of the discharge tube improves.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS AND SIGNS

A FIRST CONDUCTOR ASSEMBLY
A' SECOND CONDUCTOR ASSEMBLY
W GLASS TUBE
14 COAXIAL WAVEGUIDE
15 INTERNAL CONDUCTOR
15*a* TONGUE-SHAPED PINCH PIECE WHICH IS DISCHARGE TUBE FIXING AND HOLDING MEANS DISPOSED IN INTERNAL CONDUCTOR
16 EXTERNAL CONDUCTOR
16*b* TONGUE-SHAPED PINCH PIECE WHICH IS DISCHARGE TUBE FIXING AND HOLDING MEANS DISPOSED IN EXTERNAL CONDUCTOR
20, 20A TO 20G DISCHARGE TUBE
21 PROXIMAL SIDE PINCH SEAL PART
22 DISTAL SIDE PINCH SEAL PART
23 ELLIPSE SPHERICAL BULGED PART
24 DISCHARGE SPACE
25 FIRST CONDUCTOR ASSEMBLY
26 SECOND CONDUCTOR ASSEMBLY
25*a*,26*a* TUNGSTEN-MADE CONDUCTOR BAR
25*b*,26*b* MOLYBDENUM FOIL
25*c*,26*c* MOLYBDENUM-MADE CONDUCTOR BAR
27 GLASS CAP PART
27A GLASS CAP
28 SHROUD

What is claimed is:

1. A discharge lamp comprising
a coaxial waveguide for high-frequency electromagnetic wave transmission,
wherein the coaxial waveguide comprises
an internal conductor, and
a pipe-shaped external conductor surrounding said internal conductor, and
a discharge tube for emitting light of discharge by plasma generated by electromagnetic waves,
wherein the discharge tube is attached to a top of the coaxial waveguide, and
is constructed in a double end shape in which both ends of a glass tube are pinched and sealed,
wherein the glass tube comprises an ellipse spherical bulged part formed in a middle of a longitudinal direction,
wherein an inside of the ellipse spherical bulged part forms discharge space,
wherein a conductor assembly is sealed and attached to at least a proximal side pinch seal part, and
wherein an electromagnetic wave irradiation part is constructed by the conductor assembly and the external conductor top of the coaxial waveguide surrounding said conductor assembly by inserting and holding the proximal side pinch seal part of the discharge tube in a top opening of the waveguide so that the conductor assembly approaches the internal conductor of the coaxial waveguide.

2. A discharge lamp as claimed in claim 1, wherein the conductor assembly is constructed by linearly connecting and integrating a conductor bar and molybdenum foil.

3. A discharge lamp as claimed in claim 2, wherein a part of the conductor assembly sealed and attached to at least the proximal side pinch seal part among a pair of the pinch seal parts protrudes to the inside of the discharge space.

4. A discharge lamp as claimed in claim 3, wherein a region protruding to the inside of the discharge space of the conductor assembly is surrounded by a ceramic coating or a glass cap part extending from the pinch seal part to which said conductor assembly is sealed and attached.

5. A discharge lamp as in claim 4, wherein the ellipse spherical bulged part is covered with hermetically sealed space defined by a cylindrical shroud for ultraviolet shielding welded to the pinch seal part.

6. A discharge lamp as in claim 3, wherein the ellipse spherical bulged part is covered with hermetically sealed space defined by a cylindrical shroud for ultraviolet shielding welded to the pinch seal part.

7. A discharge lamp as in claim 2, wherein the ellipse spherical bulged part is covered with hermetically sealed space defined by a cylindrical shroud for ultraviolet shielding welded to the pinch seal part.

8. A discharge lamp as claimed in claim 1, wherein a part of the conductor assembly sealed and attached to at least the proximal side pinch seal part among a pair of the pinch seal parts protrudes to the inside of the discharge space.

9. A discharge lamp as claimed in claim 8, wherein a region protruding to the inside of the discharge space of the conductor assembly is surrounded by a ceramic coating or a glass cap part extending from the pinch seal part to which said conductor assembly is sealed and attached.

10. A discharge lamp as in claim 9, wherein the ellipse spherical bulged part is covered with hermetically sealed space defined by a cylindrical shroud for ultraviolet shielding welded to the pinch seal part.

11. A discharge lamp as in claim 8, wherein the ellipse spherical bulged part is covered with hermetically sealed space defined by a cylindrical shroud for ultraviolet shielding welded to the pinch seal part.

12. A discharge lamp as in claim 1, wherein the ellipse spherical bulged part is covered with hermetically sealed space defined by a cylindrical shroud for ultraviolet shielding welded to the pinch seal part.

13. A discharge lamp comprising:
a coaxial waveguide comprising an internal conductor and a pipe-shaped external conductor surrounding the internal conductor, and
a discharge tube comprising:
a glass tube having:
an ellipse spherical bulged part formed in a middle of a longitudinal direction, an inside of which forms a discharge space, and
both ends pinched and sealed; and
a conductor assembly sealed and attached to an end of the glass tube, and
wherein the discharge tube is inserted conductor assembly end first and held in a top opening of the coaxial waveguide.

14. The discharge lamp of claim 13, wherein the discharge tube further comprises a second conductor assembly sealed and attached to the other end of the glass tube.

15. The discharge lamp of claim 13, wherein the ellipse spherical bulged part is covered with a shroud for ultraviolet shielding.

16. The discharge lamp of claim 13, wherein the conductor assembly is constructed by linearly connecting and integrating a conductor bar and molybdenum foil.

17. A method of manufacturing a discharge lamp comprising a coaxial waveguide and a discharge tube, the method comprising:
constructing the discharge tube by
forming an ellipse spherical bulged part in a middle of a longitudinal direction of a glass tube having a double end shape, wherein an inside of the ellipse spherical bulged part forms discharge space, pinching and sealing both ends of the glass tube, and sealing and attaching a conductor assembly to an end the glass tube;

constructing the coaxial waveguide with an internal conductor and a pipe-shaped external conductor surrounding said internal conductor;

adapting the coaxial waveguide to hold the discharge tube in a top opening thereof; and inserting the discharge tube conductor assembly end first into the top opening of the coaxial waveguide.

18. The method of manufacturing a discharge lamp of claim 17, wherein constructing the discharge tube further comprises sealing and attaching a second conductor assembly to the other end of the glass tube.

19. The method of manufacturing a discharge lamp of claim 17 further comprising:

covering the ellipse spherical bulged part with a shroud for ultraviolent shielding.

20. The method of manufacturing a discharge lamp of claim 17, further comprising constructing the conductor assembly by linearly connecting and integrating a conductor bar and molybdenum foil.

* * * * *